US008410878B1

(12) United States Patent
Takaya et al.

(10) Patent No.: US 8,410,878 B1
(45) Date of Patent: Apr. 2, 2013

(54) CONTACT DEVICE AND ELECTROMAGNETIC SWITCH USING CONTACT DEVICE

(75) Inventors: Kouetsu Takaya, Kounosu (JP); Kenji Suzuki, Kounosu (JP); Yasuhiro Naka, Kounosu (JP)

(73) Assignees: Fuji Electric Co., Ltd., Kawasaki-Shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/519,734

(22) PCT Filed: Jun. 14, 2011

(86) PCT No.: PCT/JP2011/003378

§ 371 (c)(1), (2), (4) Date: Aug. 7, 2012

(87) PCT Pub. No.: WO2012/020528

PCT Pub. Date: Feb. 16, 2012

(30) Foreign Application Priority Data

Aug. 11, 2010 (JP) ..... 2010-180241

(51) Int. Cl.
*H01H 9/30* (2006.01)

(52) U.S. Cl. ..... 335/201

(58) Field of Classification Search ..... 335/201
See application file for complete search history.

(56) References Cited

U.S. PATENT DOCUMENTS

| | | | | |
|---|---|---|---|---|
| 4,786,770 | A * | 11/1988 | Hamano et al. | 218/23 |
| 5,514,844 | A * | 5/1996 | Hamano et al. | 218/57 |
| 5,519,370 | A * | 5/1996 | Perreira et al. | 335/154 |
| 5,837,953 | A * | 11/1998 | Ito et al. | 218/30 |
| 5,903,203 | A * | 5/1999 | Elenbaas | 335/179 |
| 7,157,995 | B2 * | 1/2007 | Nishida et al. | 335/126 |
| 8,274,007 | B2 * | 9/2012 | Blalock et al. | 218/129 |

FOREIGN PATENT DOCUMENTS

| | | | |
|---|---|---|---|
| JP | 2007-123058 | A | 5/2007 |
| JP | 2010-10057 | A | 1/2010 |

* cited by examiner

*Primary Examiner* — Ramon Barrera
(74) *Attorney, Agent, or Firm* — Manabu Kanesaka

(57) ABSTRACT

The present invention provides a contact device capable of narrowing a gap between a fixed contactor and a movable contactor and reducing the number of parts and the production costs, and an electromagnetic switch that uses the contact device. The contact device has a pair of columnar fixed contactors (6*a*, 6*b*) which are fixed to a surface of an insulation airtight container (4) while keeping a predetermined space therebetween, each having at least a tip end contact surface protruding into the insulation container; a movable contactor (11) that is disposed so as to be capable of contacting with and separating from the pair of fixed contactors (6*a*, 6*b*); and a pair of arc extinguishing annular permanent magnets (9*a*, 9*b*) which is respectively attached to outer circumferential surfaces of the pair of fixed contactors (6*a*, 6*b*) and drives an arc outwardly.

4 Claims, 3 Drawing Sheets

CONTACT DEVICE AND ELECTROMAGNETIC SWITCH USING CONTACT DEVICE

RELATED APPLICATIONS

The present application is National Phase of International Application No. PCT/JP2011/003378 filed Jun. 14, 2011, and claims priority from Japanese Application No. 2010-180241, filed Aug. 11, 2010.

TECHNICAL FIELD

The present invention relates to a contact device having a fixed contactor and a movable contactor interposed into a current path, and an electromagnetic switch that uses the contact device, the contact device being capable of easily extinguishing an arc that is generated when the fixed contactor and the movable contactor are opened; that is, when the current is interrupted.

BACKGROUND ART

Among conventional electromagnetic relays and electromagnetic contactors functioning as contact devices for opening and closing current paths, various contact mechanisms have been proposed for extinguishing an arc that is generated when movable contactors and fixed contactors are opened to be separated from each other, in order to bring an open state by interrupting a current from a closed state of the contact mechanisms where the fixed contactor and the movable contactor are in contact with each other.

For example, there is proposed an electromagnetic relay that has a pair of fixed contactors disposed away from each other by a predetermined distance, a movable contactor disposed so as to be capable of contacting with and separating from the pair of fixed contactors, and an electromagnetic block driving the movable contactor. In the electromagnetic relay, a U-shaped magnetic holding member is positioned on the outside of a sealing container that faces both side surfaces such that the fixed contactors and the movable contactor face each other, and two pairs of permanent magnets are positioned on the inside of the magnetic holding member in order to extinguish an arc easily by stretching the arc using a magnetic force of the permanent magnets (see Patent Document 1, for example).

Patent Document 1: Japanese Patent Application Publication No. 2010-10057

Incidentally, according to the prior art described in Patent Document 1, each pair of permanent magnets is positioned facing each other in the position where the pair of fixed contactors and the movable contactor face each other, so that the arc, which is generated when the movable contactor is separated from the pair of fixed contactors, can be pulled by the magnetic force of the permanent magnets and thereby extinguished easily.

However, although the arc can be stretched and extinguished easily by the magnetic force of the permanent magnets, the prior art has an unsolved problem where the gap between the pair of fixed contactors and the movable contactor needs to be enlarged in order to reliably eliminate the arc.

Another unsolved problem of the prior art is that a U-shaped magnetic supporting member and two pairs of the permanent magnets supported by the magnetic supporting member are required on the outside of the sealing container, which results in an increase in the number of parts and assembly processes, as well as the production costs.

The present invention, therefore, was contrived in view of the unsolved problems described above, and an object of the present invention is to provide a contact device and an electromagnetic switch using the contact device, which are capable of narrowing the gap between the fixed contactors and the movable contactor and reducing the number of parts and the production costs.

DISCLOSURE OF THE INVENTION

In order to achieve the object described above, a first aspect of a contact device according to the present invention has a pair of columnar fixed contactors which is fixed to a surface of an insulation container while keeping a predetermined space therebetween and each has at least a tip end contact surface protruding into the insulation container; a movable contactor that is disposed so as to be capable of contacting with and separating from the pair of fixed contactors; and a pair of arc extinguishing annular permanent magnets which is respectively attached to outer circumferential surfaces of the pair of fixed contactors and drive an arc outwardly.

According to this configuration, the arc extinguishing annular permanent magnets that are magnetized in an axial direction are attached to the outer circumferential surfaces of the columnar fixed contactors. Therefore, when an arc is generated by separating the movable contactor from the fixed contactors, the generated arc can be driven to the outside of the arc extinguishing annular permanent magnets by means of a magnetic force of the arc extinguishing annular permanent magnets. In addition, cooling of the arc can be facilitated by rotating the arc in a circumferential direction by means of a magnetic field of a current passing through the fixed contactors; thereby interrupting the current in a short gap.

In a second aspect of the contact device according to the present invention, parts of the arc extinguishing annular permanent magnets on the movable contactor side are magnetized to an N-pole.

According to this configuration, the parts of the arc extinguishing annular permanent magnets on the movable contactor side are magnetized to an N-pole. This results in creating a magnetic force that reaches an S-pole from the N-pole through the outside of the permanent magnets, and driving the arc to the outside of the arc extinguishing annular permanent magnets.

In a third aspect of the contact device according to the present invention, the insulation container is an airtight container encapsulating gas therein.

According to this configuration, the fixed contacts and the movable contact are disposed within the airtight container encapsulating gas. Thus, the arc can be eliminated reliably.

One aspect of an electromagnetic switch according to the present invention has the contact device in any one of the first to third aspects described above, wherein the movable contactor is coupled to a movable core of an operation electromagnet and the fixed contactors are respectively connected to external connection terminals.

This configuration can provide an electromagnetic switch that can reduce the number of parts, the number of assembly processes, and the production costs.

According to the present invention, the arc extinguishing annular permanent magnets are positioned on the outer circumferential surfaces of the columnar fixed contactors. Therefore, when an arc is generated in an open state of the contact device where the movable contactor is separated from the fixed contactors, the arc can be driven to the outside of the arc extinguishing annular permanent magnets by means of the magnetic force of the arc extinguishing annular permanent magnets, and the magnetic field of the current passing through the fixed contactors can facilitate the cooling of the arc by rotating the arc in the circumferential direction. For this reason, the gap between the fixed contactors and the movable contactors can be shortened. Moreover, simply attaching the arc extinguishing annular permanent magnets to the outer circumferential surfaces of the fixed contactors can reduce the number of parts, the number of assembly processes, and the production costs.

An electromagnetic contactor capable of reducing the number of parts, the number of assembly processes, and the production costs can be provided by applying the contact device having the effects described above, to the electromagnetic switch.

BRIEF DESCRIPTION OF THE DRAWINGS

FIG. 2(*b*) is a cross-sectional diagram taken along line A-A of FIG. 2(*a*)

BEST MODE FOR CARRYING OUT THE INVENTION

An embodiment of the present invention is described hereinafter with reference to the diagrams.

Figure 1:
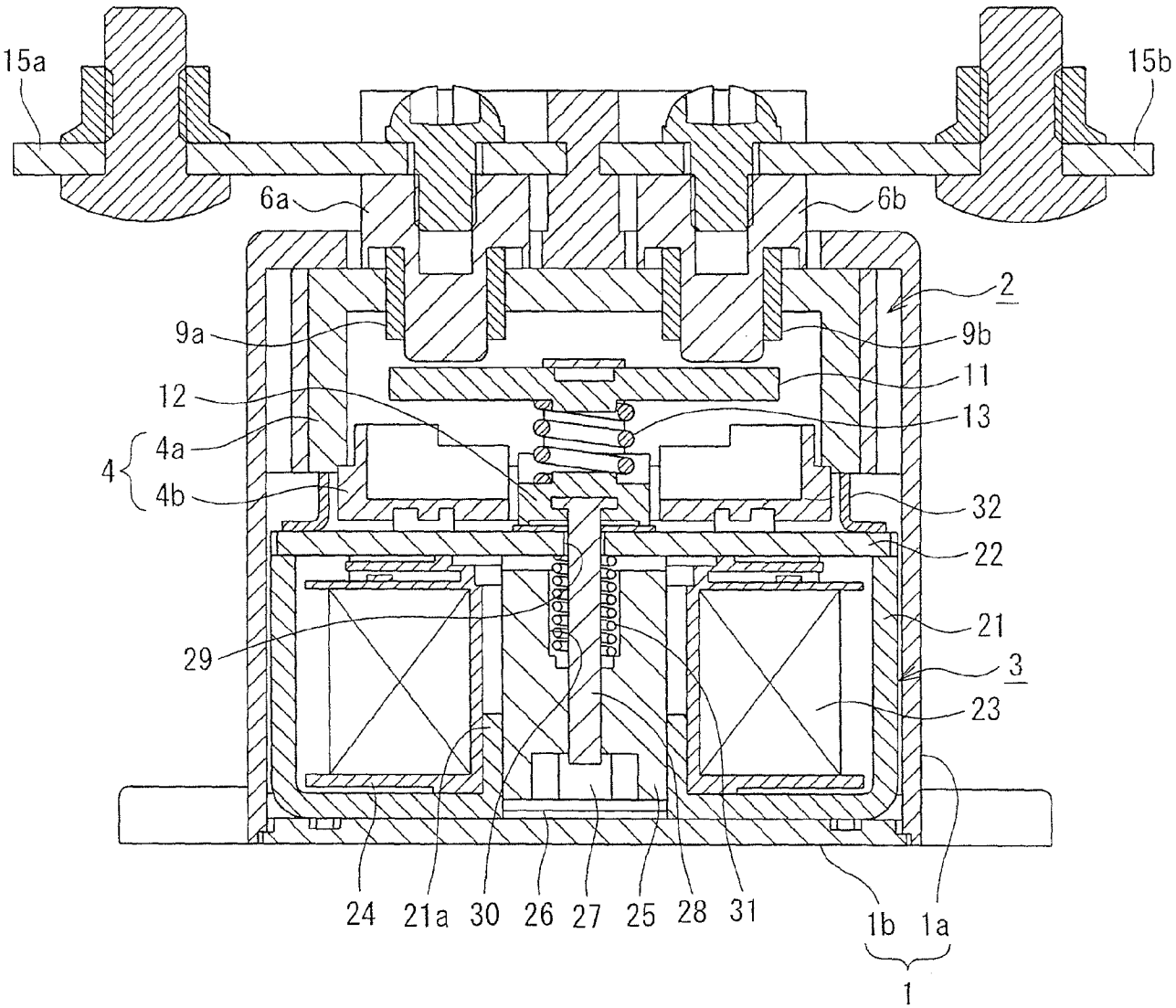
FIG. 1 is a cross-sectional diagram showing a first embodiment in which the present invention is applied to an electromagnetic contactor.

FIG. 1 is a cross-sectional diagram showing an example in which a contact device of the present invention is applied to an electromagnetic contactor functioning as an electromagnetic switch. In FIG. 1, reference numeral 1 represents an outer case made from, for example, a synthetic resin. This outer case 1 is configured by a bottomed tubular body 1*a* having an opened lower end surface, and a bottom plate 1*b* that closes the lower end surface of the bottomed tubular body 1*a*.

Within the outer case 1, a contact device 2 in which a contact mechanism is disposed, and an electromagnetic unit 3 for driving the contact device 2 are stored in a manner that the electromagnetic unit 3 is positioned on the bottom plate 1*b*.

Figure 2:
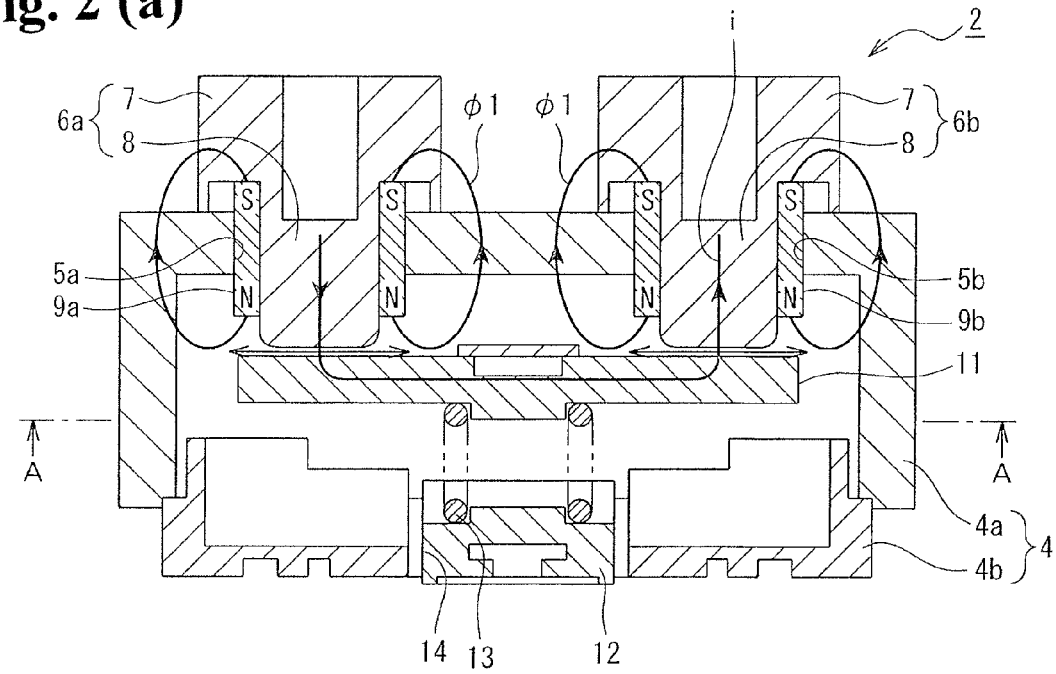
FIG. 2(*a*) is an enlarged cross-sectional diagram of a contact device of the present invention.
Figure 2:
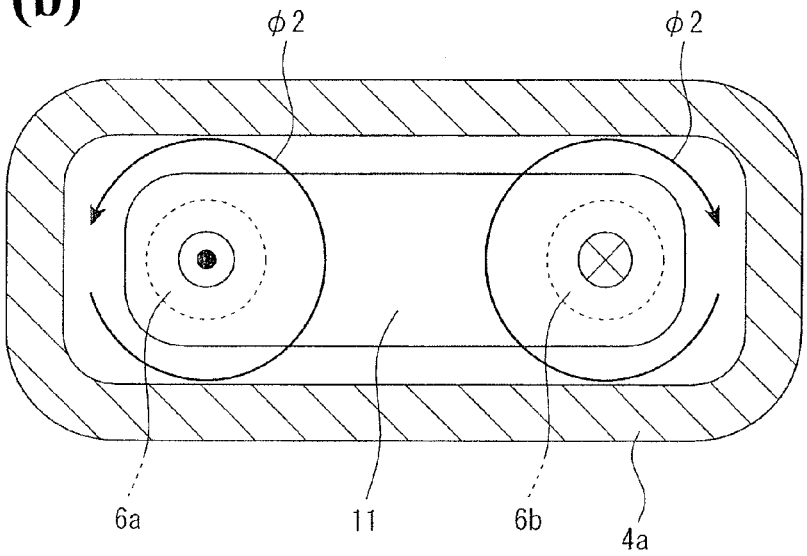

As clearly shown in FIGS. 2(*a*), 2(*b*) and 3, the contact device 2 has an insulation airtight container 4 that has a dual structure constituted from a substantially cuboid upper case 4*a* and lower case 4*b* having opened lower ends. An upper surface of the insulation airtight container 4 is provided with through-holes 5*a*, 5*b* with circular cross sections, disposed in a longitudinal direction with a predetermined space therebetween. A pair of fixed contactors 6*a*, 6*b*, made from copper, for example, is inserted into the through-holes 5*a*, 5*b* and fixed thereto by an adhesive or the like.

Each of the fixed contactors 6*a*, 6*b* is configured by a large-diameter head part 7 provided in an upper part and a small-diameter cylinder part 8 provided in a lower part and joined coaxially to the large-diameter head part 7. Cylindrical arc extinguishing annular permanent magnets 9*a*, 9*b* are attached and fixed to outer circumferential surfaces of the small-diameter cylinder parts 8 by an adhesive or the like. Each of these arc extinguishing annular permanent magnets 9*a*, 9*b* is magnetized in an axial direction such that a lower surface side thereof facing a movable contactor 11, described hereinafter, is magnetized to an N-pole and the large-diameter head part 7 side is magnetized to an S-pole.

Here, lower end surfaces of the arc extinguishing annular permanent magnets 9*a*, 9*b* are positioned in a manner as to be located higher than lower end surfaces of the small-diameter cylinder parts 8 of the fixed contactors 6*a*, 6*b*, but may be positioned in a manner as to be flush with lower surfaces of the small-diameter cylinder parts 8. In other words, as described hereinafter, the height of the lower end surfaces of the arc extinguishing annular permanent magnets 9*a*, 9*b* is not particularly limited as long as an arc can be driven to the outside of the arc extinguishing annular permanent magnets 9*a*, 9*b*.

The fixed contactors 6*a*, 6*b* attached with the arc extinguishing annular permanent magnets 9*a*, 9*b* are fixed to the upper case 4*a* by an adhesive or the like to seal the through-holes 5*a*, 5*b*, while the arc extinguishing annular permanent magnets 9*a*, 9*b* and the small-diameter cylinder parts 8 are inserted into the through-holes 5*a*, 5*b* of the upper case 4*a*.

In the contact device 2, the flat movable contactor 11 is disposed facing the lower end surfaces of the small-diameter cylinder parts 8 of the fixed contactors 6*a*, 6*b*, with a predetermined short gap therewith, so as to be capable of contacting with and separating from these lower end surfaces. This movable contactor 11 is urged upward by a contact spring 13 and attached to a contactor holder 12.

The contactor holder 12 is inserted into an insertion hole 14 formed in the lower case 4*b*, and guided in a vertical direction. The contactor holder 12 is coupled to a movable core of the electromagnetic unit 3, which is described hereinafter, and then driven in the vertical direction.

The insulation airtight container 4 configured by the upper case 4*a* and the lower case 4*b* encapsulates gas therein.

Furthermore, external connection terminal strips 15*a*, 15*b* are screwed to the large-diameter head parts 7 of the fixed contactors 6*a*, 6*b*.

Figure 3:
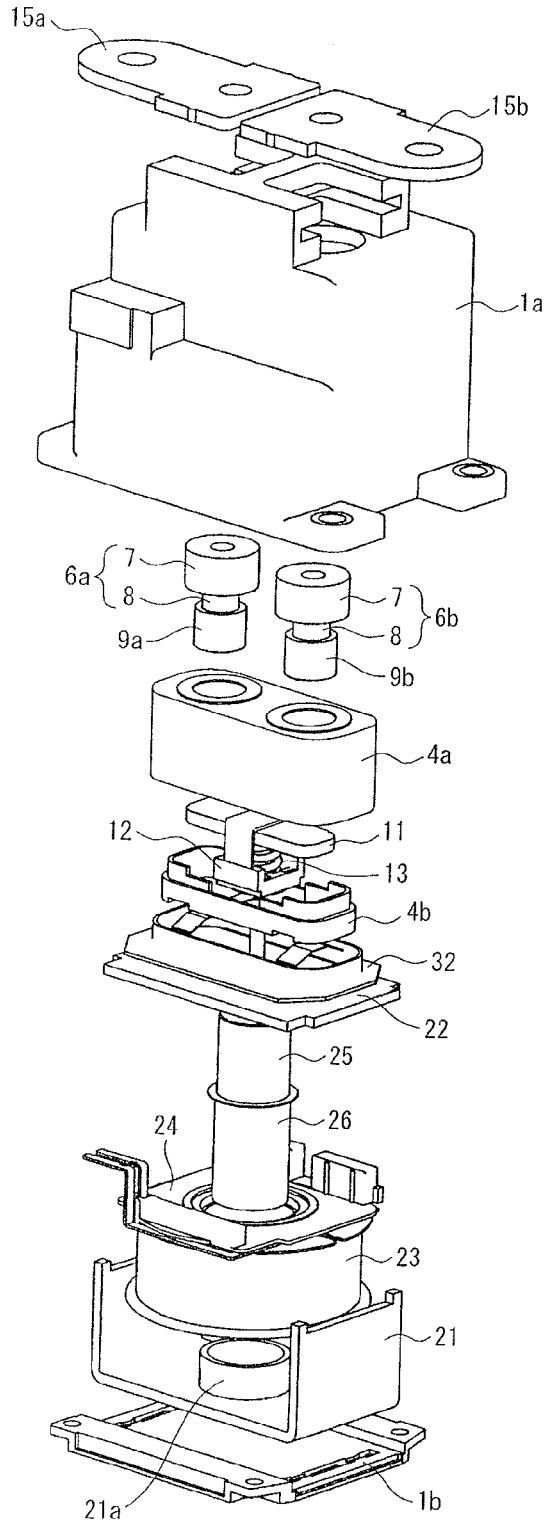
FIG. 3 is an exploded perspective view of an electromagnetic contactor according to the present invention.

As shown in FIGS. 1 and 3, the electromagnetic unit 3 has a magnetic yoke 21 that is in a U-shape as viewed laterally. A tubular part 21*b* having an opened lower end is formed in a central part of a bottom plate part 21*a* of the magnetic yoke 21. An upper surface of the magnetic yoke 21 is joined to an upper surface magnetic yoke 22.

A coil holder 24 having an exciting coil 23 wrapped therearound is attached to an outer circumferential surface of the tubular part 21*b* of the magnetic yoke 21, and a bottomed tubular cap 26 that has a movable core 25 installed slidably therein is disposed on an inner circumferential surface of the tubular part 21*b*. A rubber seat 27, which absorbs an impact of the falling of the movable core 25 by contacting with a bottom surface of the movable core 25, is disposed on a bottom surface of the cap 26.

A coupling shaft 28 is fitted to a central part of the movable core 25. A head part of the coupling shaft 28 is extended upward via a through-hole 29 formed in the upper surface magnetic yoke 22, and is coupled to the contactor holder 12.

Moreover, a spring insertion hole 30 is formed around the coupling shaft 28 of the movable core 25, and a return spring 31 for urging the movable core 25 downward is attached between the spring insertion hole 30 and the upper surface magnetic yoke 22.

In addition, the insulation airtight container 4 and the upper surface magnetic yoke 22 are bonded to each other by a bonding member 32.

Operations of the embodiment are described next.

It supposes that the external connection terminal strip 15*a* is connected to, for example, a power supply source for supplying a large current, and that the external connection terminal strip 15*b* is connected to a load.

Also, it supposes, in this state, that the exciting coil 23 of the electromagnetic unit 3 is in a non-power-supply state and that no excitation force is generated in the electromagnetic unit 3 for moving the movable core 25. In this state, the movable core 25 is urged by the return spring 31 in a downward direction to separate from the upper surface magnetic yoke 22 and brought into an abutment with the rubber seat 27. Therefore, the movable contactor 11, which is supported by the contactor holder 12 that is coupled to the movable core 25 by the coupling shaft 28, faces the lower end surfaces of the small-diameter cylinder parts 8 of the fixed contactors 6*a*, 6*b* with the predetermined short gap therewith, and the contact device 2 is opened.

In this open state of the contact device 2, applying a voltage to the exciting coil 23 of the electromagnetic unit 3 produces the excitation force in the electromagnetic unit 3, pushing the movable core 25 upward against the return spring 31. In response to this, the contactor holder 12 that is coupled to the movable core 25 by the coupling shaft 28 moves upward, and the movable contactor 11 is brought into contact with bottom surfaces of the small-diameter cylinder parts 8 of the fixed contactors 6*a*, 6*b* by contact pressure of the contact spring 13.

As a result, the contact device 2 enters a closed state in which a large current i of an external power supply source is supplied to the load via the external connection terminal strip 15*a*, the fixed contactor 6*a*, the movable contactor 11, the fixed contactor 6*b*, and the external connection terminal strip 15*b*.

When interrupting the supply of current to the load in this closed state of the contact device 2, the application of voltage to the exciting coil 23 of the electromagnetic unit 3 is stopped.

Consequently, the excitation force for moving the movable core 25 upward disappears in the electromagnetic unit 3, whereby the movable core 25 is dropped by the urging force of the return spring 31. By this falling of the movable core 25, the contactor holder 12 that is coupled thereto by the coupling shaft 28, is dropped. Accordingly, the movable contactor 11 stays in contact with the fixed contactors 6*a*, 6*b*, while the contact pressure is applied to the movable contactor 11 by the contact spring 13. Thereafter, as soon as the contact pressure of the contact spring 13 disappears, the contact device 2 enters the open state in which the movable contactor 11 separates downward from the fixed contactors 6*a*, 6*b*.

Once the contact device 2 enters the open state, an arc is generated between the fixed contactors 6*a*, 6*b* and the movable contactor 11. At this moment, the arc extinguishing annular permanent magnets 9*a*, 9*b* are magnetized such that the lower end side thereof, which faces the movable contactor 11 side, is magnetized to the N-pole, and that the upper end side of the same is magnetized to the S-pole. Then, a magnetic flux that reaches the S-pole on the upper end side of the arc extinguishing annular permanent magnets 9*a*, 9*b* from the N-pole on the lower end side through the outside of the arc extinguishing annular permanent magnets 9*a*, 9*b*, as shown in FIG. 2(*a*), is formed. Therefore, the arc is driven to the outside of the arc extinguishing annular permanent magnets 9*a*, 9*b* in accordance with Fleming's left-hand rule due to the magnetic flux $\phi$1 of the arc extinguishing annular permanent magnets 9*a*, 9*b* and the current flowing through the fixed contactors 6*a*, 6*b*.

Moreover, because the high current flows downward through the fixed contactor 6*a*, a magnetic field of a self current path of the fixed contactor 6*a* generates a counterclockwise magnetic flux $\phi$2, as shown in FIG. 2(*b*). This magnetic flux $\phi$2 facilitates that the arc rotates in the circumferential direction, and thereby facilitating the cooling of the arc (energy absorption).

The configuration for facilitating the cooling of the arc can contribute to a reduction of the number of parts because it is only necessary to attach the arc extinguishing annular permanent magnets 9*a*, 9*b* to the outer circumferential surfaces of the small-diameter cylinder parts 8 of the fixed contactors 6*a*, 6*b*; thus, the conventional magnetic supporting member functioning as the magnetic yoke is not required. As a result, the number of assembly processes and the production costs can be reduced.

Moreover, by precisely extinguishing the arc, the gap between the fixed contactors 6*a*, 6*b* and the movable contactor 11, can be narrowed, and an open time period for interrupting the current is reduced.

The present embodiment has described the case in which the fixed contactors 6*a*, 6*b* are configured by the large-diameter head parts 7 and the small-diameter cylinder parts 8, but the present invention is not limited thereto; therefore, the entire fixed contactors 6*a*, 6*b* may be formed into cylinders.

The cross-sectional shape of the small-diameter cylinder parts 8 of the fixed contactors 6*a*, 6*b* is not limited to a circular shape; therefore, the cross-sectional shape of the small-diameter cylinder parts 8 can be any shape, including ellipses and squares, and in accordance with this, the cross-sectional shape of the arc extinguishing annular permanent magnets 9*a*, 9*b* may be changed accordingly.

Furthermore, the present embodiment has described the case in which outer circumferential surfaces of the arc extinguishing annular permanent magnets 9*a*, 9*b* are partially exposed, but the present invention is not limited thereto; therefore, the exposed parts of the arc extinguishing annular permanent magnets 9*a*, 9*b* may be covered with a non-magnetic tubular body.

Moreover, the present embodiment has described the case in which the insulation airtight container 4 functioning as an arc-extinguishing chamber encapsulates gas therein, but the present invention is not limited thereto; therefore, the gas may not be encapsulated.

In addition, the present embodiment has described the case in which the movable contactor 11 is formed flat, but the present invention is not limited thereto; therefore, a central part between contact points of the movable contactor 11 that faces the fixed contactors 6*a*, 6*b*, may be shaped into a concave or a convex.

The configuration of the electromagnetic unit 3 is not limited to the present embodiment; therefore, any configuration can be applied as long as the contactor holder 12 can be moved electromagnetically.

Moreover, the present embodiment has described the case in which the contact device 2 of the present invention is applied to an electromagnetic contactor, but the present invention is not limited thereto; therefore, the contact device 2 can be applied to an electromagnetic relay or any switches, including an electromagnetic switch.

INDUSTRIAL APPLICABILITY

The present invention can provide a contact device in which an arc, which is generated when the contact device is opened, can be driven to the outside of the arc extinguishing annular permanent magnets that are disposed on the outer circumferential surfaces of the columnar fixed contactors, and can be rotated in the circumferential direction in order to be cooled; and in which the gap between the fixed contactors and the movable contactor can be reduced. The present invention can also provide an electromagnetic switch that uses this contact device.

EXPLANATION OF REFERENCE NUMERALS

1 . . . Outer case, 2 . . . Contact device, 3 . . . Electromagnetic unit, 4 . . . Insulation airtight container, 4*a* . . . Upper case, 4*b* . . . Lower case, 6*a*, 6*b* . . . Fixed contact, 7 . . . Large-diameter head part, 8 . . . Small-diameter cylinder part, 9*a*, 9*b* . . . Arc extinguishing annular permanent magnet, 11 . . . Movable contact, 12 . . . Contactor holder, 13 . . . Contact spring, 15*a*, 15*b* . . . External connection terminal strip, 21 . . . Magnetic yoke, 22 . . . Upper surface magnetic yoke, 23 . . . Exciting coil, 24 . . . Coil holder, 25 . . . Movable core, 26 . . . Cap, 28 . . . Coupling shaft, 31 . . . Return spring

What is claimed is:

1. A contact device, comprising:

a pair of columnar fixed contactors fixed to a surface of an insulation container while keeping a predetermined space therebetween, each having at least a tip end contact surface protruding into the insulation container;

a movable contactor disposed so as to be capable of contacting with and separating from the pair of columnar fixed contactors; and a pair of arc extinguishing annular permanent magnets respectively attached to outer circumferential surfaces of the pair of columnar fixed contactors and driving an arc outwardly.

2. The contact device according to claim 1, wherein the arc extinguishing annular permanent magnets are magnetized to an N-pole at a side facing the movable contactor.

3. The contact device according to claim 1, wherein the insulation container has an airtight container and the airtight container encapsulates gas therein.

4. An electromagnetic switch, comprising the contact device according to claim 1;

wherein the movable contactor is coupled to a movable core of an electromagnetic device and the fixed contactors are respectively connected to external connection terminals.

* * * * *